US007043836B2

(12) United States Patent
Motohashi

(10) Patent No.: US 7,043,836 B2
(45) Date of Patent: May 16, 2006

(54) MANUFACTURING METHOD OF ROCKER ARM

(75) Inventor: Nobutsuna Motohashi, Tokyo (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 10/602,773

(22) Filed: Jun. 25, 2003

(65) Prior Publication Data

US 2004/0000277 A1 Jan. 1, 2004

(30) Foreign Application Priority Data

Jun. 26, 2002 (JP) ..... P.2002-185577

(51) Int. Cl.
*B21D 53/84* (2006.01)
*F01L 1/18* (2006.01)

(52) U.S. Cl. ..... 29/888.2; 123/90.39; 74/559

(58) Field of Classification Search ..... 29/888.02; 123/90.39, 90.44, 90.45, 90.41; 74/519, 74/559

See application file for complete search history.

(56) References Cited

U.S. PATENT DOCUMENTS

| | | | | |
|---|---|---|---|---|
| 5,720,245 | A | 2/1998 | Calka | |
| 5,774,984 | A * | 7/1998 | Kotani | 29/888.2 |
| 6,199,527 | B1 * | 3/2001 | Okubo et al. | 123/90.41 |
| 6,334,416 | B1 * | 1/2002 | Okubo et al. | 123/90.42 |
| 6,425,261 | B1 * | 7/2002 | Burk et al. | 62/506 |
| 6,508,215 | B1 * | 1/2003 | Okubo et al. | 123/90.41 |
| 6,588,101 | B1 * | 7/2003 | Okubo et al. | 29/888.2 |
| 6,601,555 | B1 * | 8/2003 | Okubo et al. | 123/90.39 |
| 6,672,266 | B1 * | 1/2004 | Okubo et al. | 123/90.39 |

FOREIGN PATENT DOCUMENTS

| | | |
|---|---|---|
| DE | 24 38 227 | 8/1974 |
| DE | 43 02 781 A1 | 2/1993 |
| DE | 197 00 863 A1 | 1/1997 |
| EP | 0 849 436 A1 | 6/1998 |
| EP | 1 057 980 A2 | 12/2000 |
| EP | 1 122 408 A1 | 8/2001 |
| JP | 2001-191139 | 7/2001 |

OTHER PUBLICATIONS

European Search Report dated Sep. 26, 2003.

* cited by examiner

*Primary Examiner*—Marc Jimenez
(74) *Attorney, Agent, or Firm*—McGinn IP Law Group, PLLC

(57) ABSTRACT

When forces given in the processes of machining in the cross direction and machining for forming a groove are adjusted and the machining is repeatedly conducted by a plurality of times, the valve engaging portion (10) is machined, and the metal flow (30) formed between the valve guide walls (28, 29) and the connecting wall (8) is prevented from being cut off. Therefore, the rigidity of the valve engaging portion (10) can be ensured, and the quality of the rocker arm (1) can be stabilized.

18 Claims, 6 Drawing Sheets

MANUFACTURING METHOD OF ROCKER ARM

SUMMARY OF THE INVENTION

The present invention relates to a manufacturing method of a rocker arm.

A conventional rocker arm is constituted in such a manner that a body and a connecting wall used as a valve stem guide portion, are provided separately from each other and the connecting wall is joined to the body by means of laser beam welding.

In the case of the above joining structure, since a metal flow between the body and the connecting wall is continuous, it is possible to ensure a sufficiently high mechanical strength itself. However, since the body and the connecting wall are formed separately from each other, it is necessary to conduct laser beam welding to join the body and the connecting wall. Therefore, the manufacturing cost is raised. Therefore, in order to abolish the process of laser beam welding, a rocker arm is proposed in which the body and the connecting wall are integrated with each other into one body.

In the rocker arm in which the body and the connecting wall are integrated into one body, the connecting wall is deformed with respect to the body by means of press forming. However, when press forming is conducted, a metal flow between the body and the connecting wall is cut off by a shock caused in the process of press forming, and the mechanical strength of the continuous portion between the body and the connecting wall is lowered.

SUMMARY OF THE INVENTION

In light of the above problem, an object of the present invention is to provide a method of manufacturing a rocker, arm by pressing forming in which the metal flow continues between both the side walls and the connecting wall.

In order to solve the aforesaid object, the invention is characterized by having the following arrangement.

Aspect 1. A method of manufacturing a rocker arm for opening and closing a valve, the method comprising the steps of:

(a) providing a metallic sheet;

(b) bending the metallic sheet to form a pair of predetermined side wall regions and an predetermined connecting wall region for connecting the pair of predetermined side wall regions;

(c) first pressing outer sides of the pair of predetermined side wall regions in a connecting direction in which the predetermined connecting wall region extends, respectively, to plastically flow so that a height of the pair of predetermined side wall regions is gradually increased;

(d) second pressing the predetermined connecting wall region so as to be recessed in a height direction perpendicular to the connecting direction; and repeating step (c) and (d) plural times, whereby a portions of the pair of predetermined side wall regions are made to be a pair of valve guide walls of a valve engaging portion which extends in the height direction, in which the predetermined connecting wall region is made to be a connecting wall of the valve engaging portion, which connects the pair of valve guide walls with each other at intermediate portion of the pair of valve guide walls in the height direction.

Aspect 2. A rocker arm for opening and closing a valve comprising:

a body including a valve engaging portion with which the valve is engaged, the valve engaging portion including a pair of valve guide walls opposed to each other and a connecting wall for connecting the valve guide walls with each other at a middle position in the height direction of the valve guide walls, wherein the body is made of one metallic sheet by plastic deformation so that a metal flow continues between both the valve guide walls and the connecting wall.

DETAILED DESCRIPTION OF PREFERRED EMBODIMENTS

Figure 1:
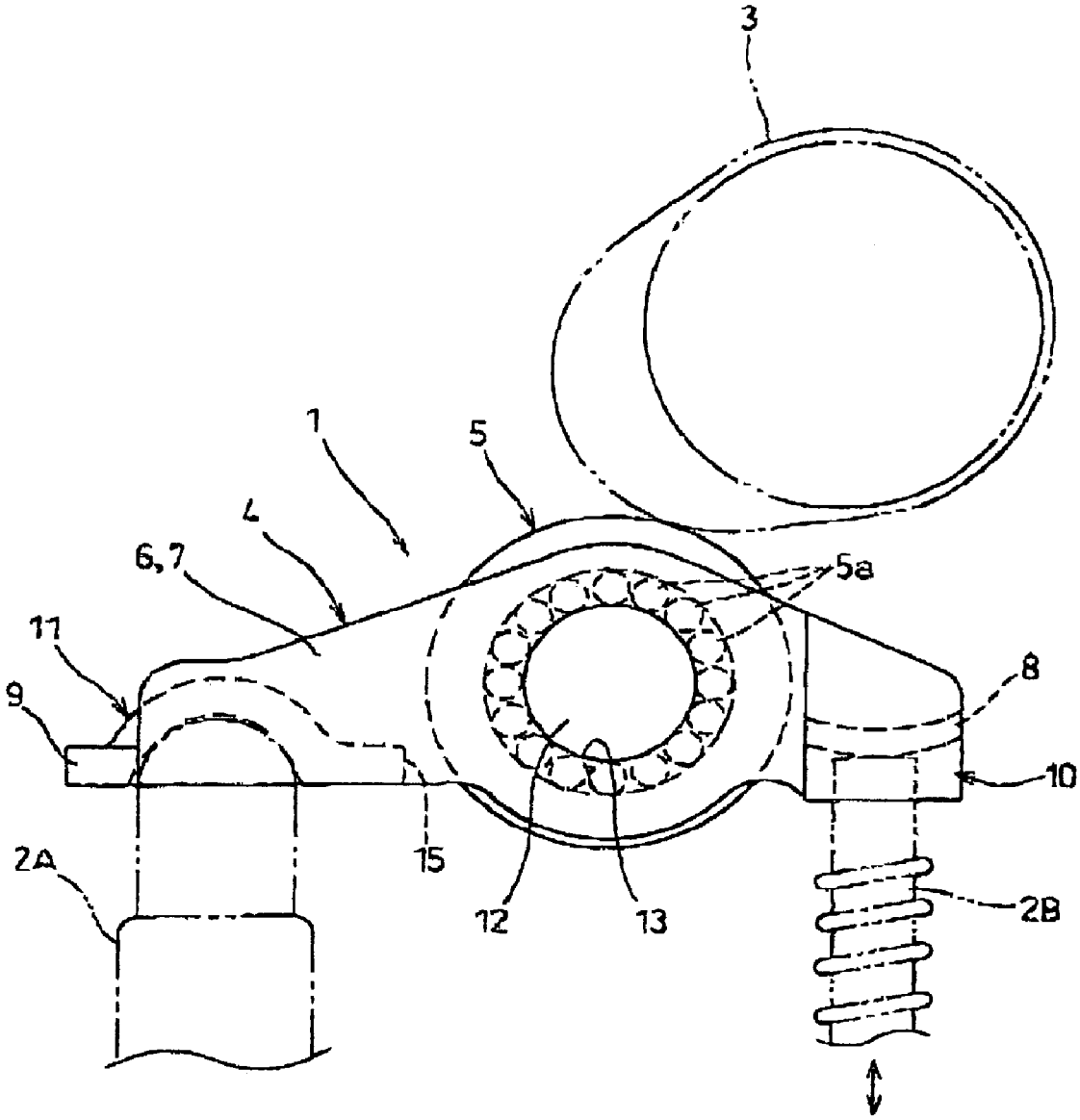
FIG. 1 is a side view showing a state of the use of the rocker arm of the embodiment of the present invention.
Figure 2:
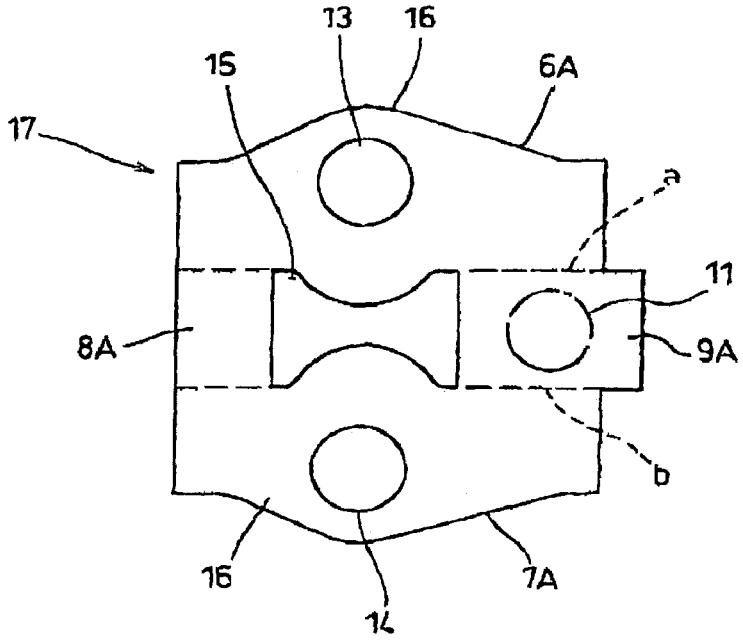
FIG. 2 is a plan view showing a first intermediate product in the case of manufacturing the rocker arm of the embodiment of the present invention.
Figure 3:
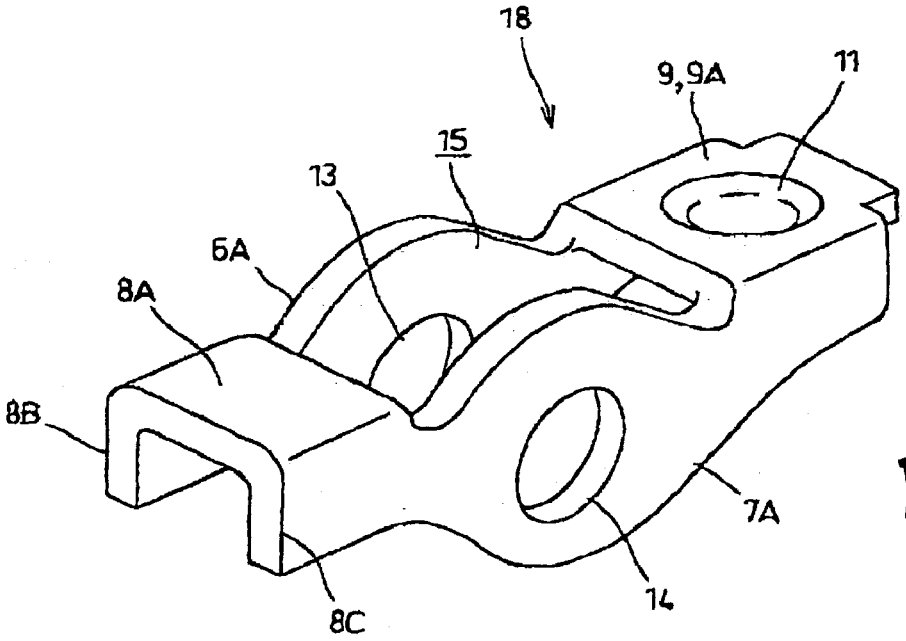
FIG. 3 is a perspective view showing a second intermediate product in the case of manufacturing the rocker arm, of the embodiment of the present invention.
Figure 4:
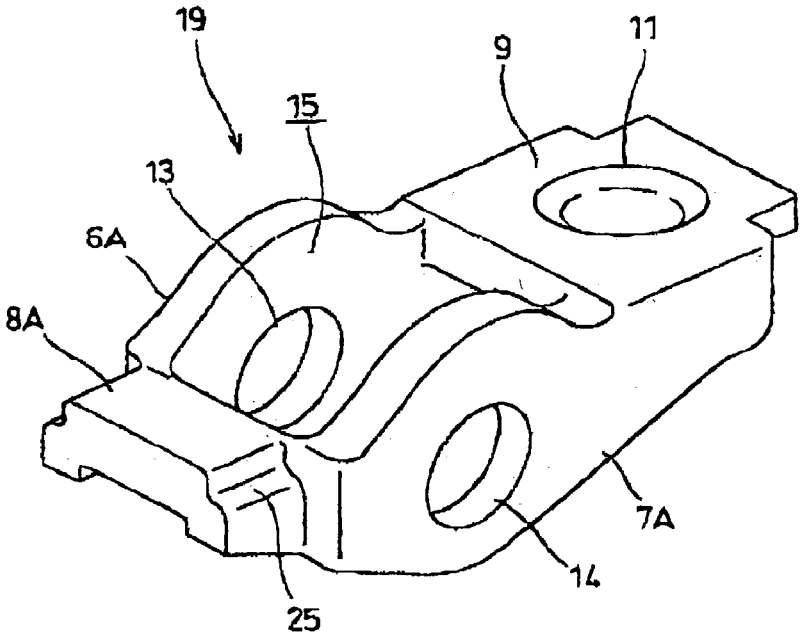
FIG. 4 is a perspective view showing a third intermediate product in the case of manufacturing the rocker arm of the embodiment of the present invention.
Figure 5:
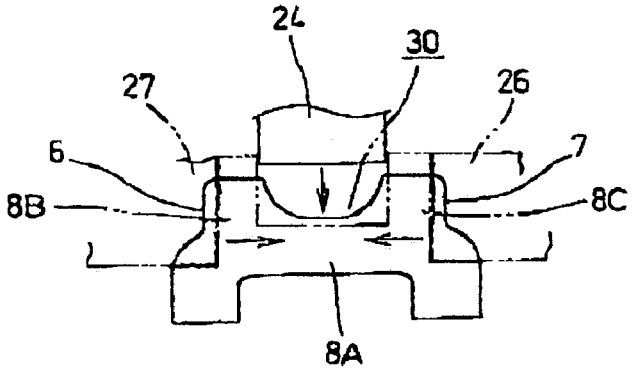
FIG. 5 is a process drawing of manufacturing a valve engaging portion of the rocker arm of the embodiment of the present invention.
Figure 6:
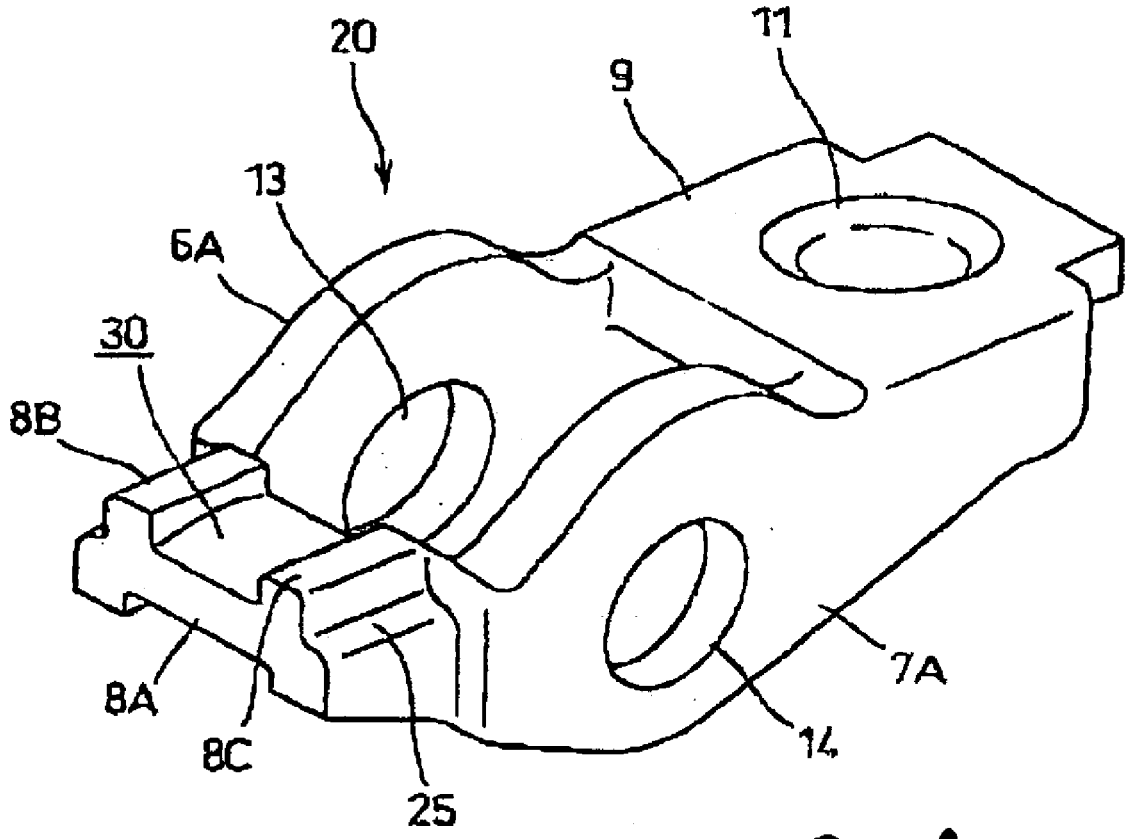
FIG. 6 is a perspective view showing a fourth intermediate product in the case of manufacturing the rocker arm of the embodiment of the present invention.
Figure 7A:
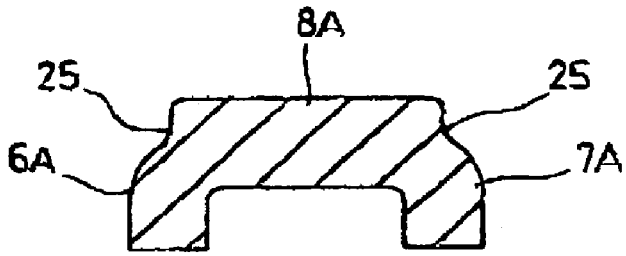
FIGS. 7A to 7C are a view showing a change in the shape of the valve engaging portion in the manufacturing process.
Figure 7B:
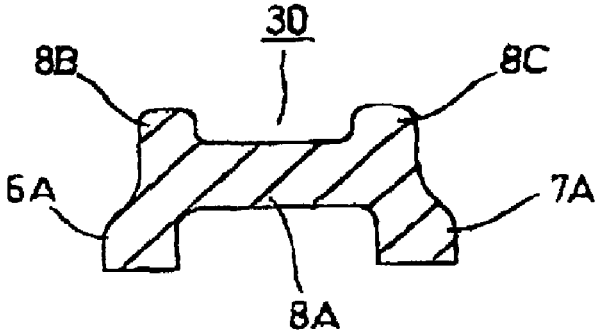
Figure 7C:
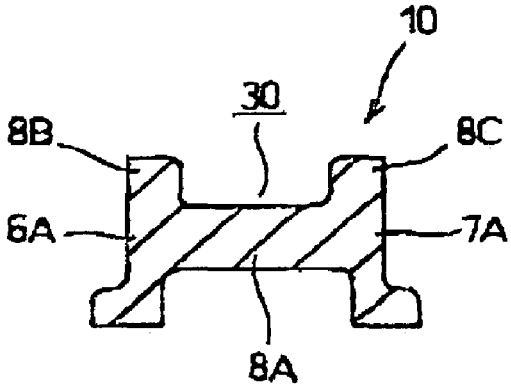
Figure 8:
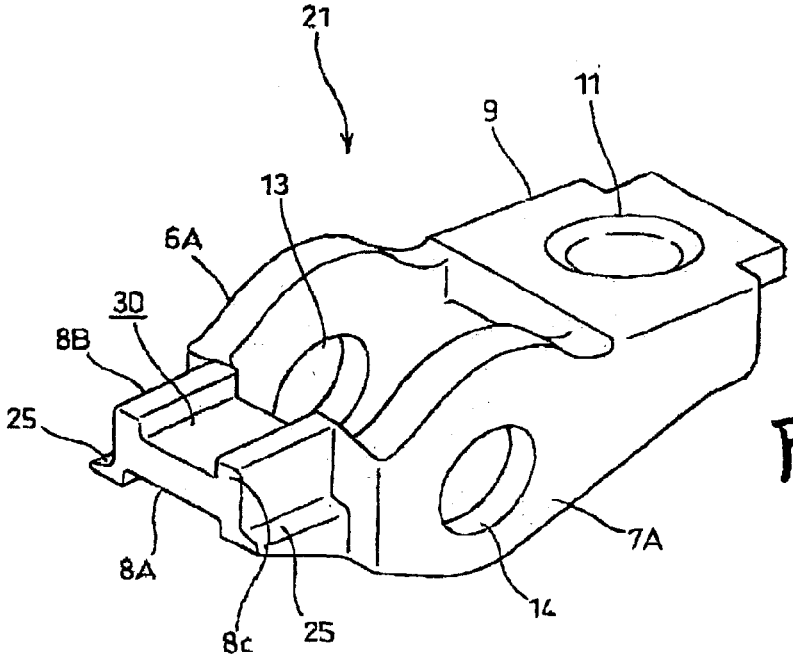
FIG. 8 is a perspective view showing a fifth intermediate product in the case of manufacturing the rocker arm of the embodiment of the present invention.
Figure 9:
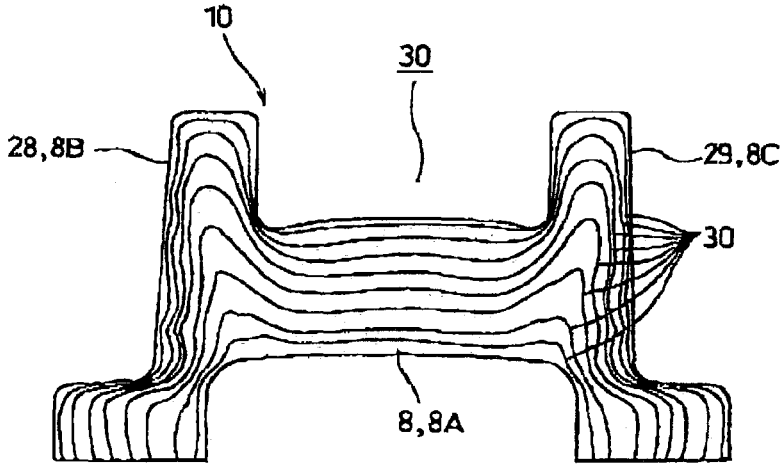
FIG. 9 is an enlarged view showing the continuity of a metal flow in the valve engaging portion.

Referring to the drawings, the rocker arm of the present invention will be explained as follows. FIG. 1 is a side view showing a state of use of the rocker arm of the present invention, FIG. 2 is a plan view showing a first intermediate product in the case of manufacturing the rocker arm, FIG. 3 is a perspective view of the second intermediate product, FIG. 4 is a perspective view of the third intermediate product, FIG. 5 is a process drawing of manufacturing a valve engaging portion, FIG. 6 is a perspective view of the fourth intermediate product, FIG. 7 is a view showing a change in the shape of the valve engaging portion in the manufacturing process, FIG. 8 is a perspective view of the fifth intermediate product, and FIG. 9 is an enlarged view showing the continuity of a metal flow in the valve engaging portion.

As shown in FIG. 1, this rocker arm 1 is of the end pivot type having the constitution in which the body 4 is tilted by the rotation of the cam 3 with one end side in the longitudinal direction of the rocker arm 1, which is supported by the lash adjuster 2A, serving as a fulcrum. According to the tilting motion of this rocker arm 1; a valve not shown in the drawing is opened and closed.

This rocker arm 1 includes the body 4 and the roller 5. This body 4 includes: a pair of side walls 6, 7 which are opposed to each other in the axial direction of the roller 5;

the connecting walls 8, 9 for connecting the side walls 6, 7 with each other, arranged on one end side and the other end side in the longitudinal direction; the valve engaging portion 10 arranged on one end side in the longitudinal direction; and the pivot receiving portion 11 arranged on the other end side in the longitudinal direction. In the middle of the side walls 6, 7, there are formed insertion holes 13, 14 into which the support shaft 12 is inserted.

The valve engaging portion 10 includes the valve guide walls 28, 29, which are formed by partially deforming the side walls 6, 7, and the connecting wall 8. A metal flow formed between the valve guide walls 28, 29 and the connecting wall 8 in the valve engaging portion 10 is continuous. The valve guide walls 28, 29 are used for guiding the valve stem 2B. The connecting wall 9 on the other end side in the longitudinal direction has the pivot receiving portion 11 for receiving an upper end portion of the lash adjuster 2.

The roller 5 is arranged in such a manner that a portion of the roller 5 sticks out from the opening 15 formed in the bottom portion between the two connecting walls 8, 9 in the body 4. This roller 5 is pivotally supported by the support shaft 12 via a plurality of needle rollers 5*a*.

Next, the method of manufacturing the rocker arm 1 is explained as follows. First of all, as shown in FIG. 2, one metallic sheet (steel sheet) is punched by means for press forming to obtain a metallic sheet member of a predetermined shape, at both side edges of which the arcuate portions 16 are provided. Next, the metallic sheet member is punched so as to form the opening 15 at the substantial center. Accordingly, the metallic sheet member is formed into a shape having the predetermined side wall regions 6A, 7A and the predetermined connecting wall regions 8A, 9A.

A central region of the predetermined connecting wall region 9A on the other end side is subjected to drawing and formed into the hemispherical pivot receiving portion 11. Regions close to the arcuate portions 16 of this metallic sheet member M are punched into the insertion holes 13, 14. In this way, the first intermediate product 17 shown in FIG. 2 is provided.

Folding is conducted on the first intermediate product 17 at positions shown by the broken lines "a" and "b" in FIG. 2. In this way, the second intermediate product 18 shown in FIG. 3 is provided.

When folding has been conducted, this second intermediate product 18 is formed into a substantial U-shape when a view is taken from the front. This second intermediate product 18 includes: a pair of side walls 6A, 7A which are arranged being opposed to each other in the axial direction; the predetermined connecting wall region 8A for connecting the predetermined valve guide wall regions 8B, 8C corresponding to one end side of the predetermined side wall regions 6A, 7A; and the predetermined connecting wall region 9A for connecting the other end sides of the predetermined side wall regions 6A, 7A. In this connection, when the first intermediate product 17 is machined into the second intermediate product 18, the predetermined connecting wall region 9A becomes the connecting wall 9 as it is.

Next, a portion of each of the predetermined side walls regions 6A, 7A of the second intermediate product 18 machined as described above, that is, the predetermined valve guide wall regions 8B, 8C and the predetermined connecting wall region 8A are further machined and formed into the valve inserting portion 10.

A predetermined metallic die is set so that the intermediate portions of the predetermined side wall regions 6A, 7A in the longitudinal direction of the second intermediate product 18 are held, and portions corresponding to the lower side of the predetermined valve guide wall regions 8, 8C are pressed from both sides toward the inside (in the cross direction) by the first metallic dies 26, 27 (shown in FIG. 6), the cross sections of which are formed into a substantial rectangle. Accordingly, the predetermined connecting wall region 8A is compressed and formed in the cross direction. Due to the compressive forming, the step-like side portions 25 are formed in the predetermined valve guide wall regions 8B, 8C. Accordingly, the wall thickness of the predetermined connecting wall region 8A is increased, and the third intermediate product 19 shown in FIG. 4 will be provided. When necessary, softening annealing is conducted on the third intermediate product 19 so as to remove the internal stress.

Next, as shown in FIG. 5, while the predetermined valve guide wall regions 8B, 8C are being pressed by the first metallic dies 26, 27, the second metallic die 24 for forming a groove, which is separated from the first metallic dies 26, 27, is abutted against the intermediate positions on the lower face side of the predetermined valve guide wall regions 8B, 8C and the second metallic die 24 for forming a groove presses the portion of the predetermined connecting wall region 8A, so that a central region on the lower face side of the predetermined connecting wall region 8A is deformed being recessed upward (in the height direction). Accordingly, both sides of the recessed portion, that is, the predetermined valve guide wall regions 8B, 8C, are made to plastically flow downward so that the height can be increased, and the groove 30 is formed by the predetermined connecting wall region 8A and the predetermined valve guide wall regions 8B, 8C. In this way, the fourth intermediate product 20 shown in FIG. 6 is provided.

Successively, while the predetermined valve guide wall regions 8B, 8C are being pressed by the first metallic dies 26, 27, the central region on the lower face side of the predetermined connecting wall region 8A is further deformed being recessed upward by the second metallic die 24. FIGS. 7A to 7C show a change in the cross section of the valve engaging portion 10 in the process of machining.

When the machining in the cross direction and the machining for forming a groove are alternately repeated by a plurality of times, as shown in FIGS. 7A to 7C, the predetermined connecting wall region 8A is gradually moved downward and the depth of the groove 30 is successively increased so that the predetermined connecting wall region 8A can be located at an intermediate portion in the height direction of the predetermined valve guide wall regions 8B, 8C, and the height of the predetermined valve guide wall regions 8B, 8C is gradually increased. In this way, the fifth intermediate product 21 shown in FIG. 8 is obtained.

Finally, after the machining in the cross direction has been conducted so that the step-shaped side portion 25 can disappear, the final machining for forming a groove is conducted and a bottom face of the predetermined connecting wall region 8A is formed into a curved face having a predetermined radius of curvature by a pressing punch used for finishing not shown so that the bottom face of the predetermined connecting wall region 8A can be formed into the connecting wall 8. The predetermined valve guide wall regions 8B, 8C are made to be the valve guide walls 28, 29. Further, the predetermined side wall regions 6A, 7A are made to be the side walls 6, 7. In this way, as shown in FIG. 1, the product having the valve engaging portion 10, the depth of which is sufficiently large, can be obtained as shown in FIG. 1.

As described above, when the machining in the cross direction and the machining for forming a groove are repeatedly conducted by a plurality of times while forces given to the first metallic dies 26, 27 and the second metallic die 24 are being adjusted, it is possible to make the metal flow 30 formed between the valve guide walls 28, 29 and the connecting wall 8 of the valve engaging portion 10 continue as shown in FIG. 9.

When the valve engaging portion 10 is machined, while forces given to conduct the machining in the cross direction and the machining for forming a groove are being adjusted, the machining is repeatedly conducted by a plurality of times so that the metal flow 30 between the valve guide walls 28, 29 and the connecting wall 8 can be made to continue. Accordingly, the rigidity of the valve engaging portion 10 can be ensured and the quality of the rocker arm 1 can be stabilized.

As can be seen from the above explanations, according to the present invention, the metal flow continues between both the side walls and the connecting wall. Therefore the rigidity of the valve engaging portion, can be ensured.

What is claimed is:

1. A method of manufacturing a rocker arm for opening and closing a valve, the method comprising:

providing a metallic sheet;

bending the metallic sheet to form a pair of predetermined side wall regions and a predetermined connecting wall region for connecting the pair of predetermined side wall regions;

first pressing a portion of outer sides of the pair of predetermined side wall regions in a connecting direction in which the predetermined connecting wall region extends, respectively, to plastically flow so that a height of the pair of predetermined side wall regions is gradually increased;

second pressing the predetermined connecting wall region so as to be recessed in a height direction perpendicular to the connecting direction; and alternately repeating the first pressing and the second pressing a plurality of times, whereby portions of the pair of predetermined side wall regions are made to be a pair of valve guide walls of a valve engaging portion which extends in the height direction, in which the predetermined connecting wall region is made to be a connecting wall of the valve engaging portion, which connects the pair of valve guide walls with each other at an intermediate portion of the pair of valve guide walls in the height direction, wherein a metal flow continues between the pair of valve guide walls, including distal ends, of the pair of valve guide walls and the connecting wall.

2. The method of manufacturing a rocker arm according to claim 1, wherein providing said metallic sheet comprises punching said metallic sheet to form a predetermined shape having said side wall regions and said connecting wall region.

3. The method of manufacturing a rocker arm according to claim 1, wherein prior to bending said metallic sheet, said metallic sheet is punched to form an opening in the center of said metallic sheet.

4. The method of manufacturing a rocker arm according to claim 1, further comprising:

drawing a central region of a second connecting wall that is disposed on an end of the rocker arm opposite to said predetermined connecting wall region, to form a hemispherical pivot receiving portion.

5. The method of manufacturing a rocker arm according to claim 1, further comprising:

softening annealing the rocker arm after first pressing outer sides of the pair of predetermined side wall regions.

6. The method of manufacturing a rocker arm according to claim 1, wherein said outer sides of said pair of predetermined side wall regions are pressed using a first die.

7. The method of manufacturing a rocker arm according to claim 6, wherein said predetermined connecting wall is pressed using a second die.

8. The method of manufacturing a rocker arm according to claim 7, wherein during the pressing of said predetermined connecting wall region by the second die, the predetermined side wall regions are made to plastically flow such that a height of the side wall regions increases.

9. The method of manufacturing a rocker arm according to claim 6, wherein the first die is set so a first portion of the outer sides of the predetermined side wall regions are held, and a second portion of the outer sides of the predetermined side wall regions are pressed toward a center of the rocker arm such that a thickness of the connecting wall regions is increased.

10. The method of manufacturing a rocker arm according to claim 1, further comprising:

forming a curvature in the surface of said predetermined connecting wall region using a pressing punch.

11. The method of manufacturing a rocker arm according to claim 1, wherein the first pressing and the second pressing are done by separate dies.

12. A method of manufacturing according to claim 1, wherein said portion of outer sides of the pair of predetermined side wall regions comprises an upper portion.

13. A method of manufacturing according to claim 1, wherein said portion of outer sides of the pair of predetermined side wall regions comprises a vicinity of a variation point of metal flow from the predetermined connecting wall regions to the predetermined side wall regions.

14. A method of manufacturing a rocker arm for opening and closing a valve, the method comprising:

providing a metallic sheet having a pair of predetermined side wall regions and a predetermined connecting wall region for connecting the pair of predetermined side wall regions;

first pressing a portion of outer sides of the pair of predetermined side wall regions in a connecting direction in which the predetermined connecting wall region extends, respectively, to plastically flow so that a height of the pair of predetermined side wall regions is gradually increased;

second pressing the predetermined connecting wall region so as to be recessed in a height direction perpendicular to the connecting direction; and alternately repeating the first pressing and the second pressing a plurality of times, whereby portions of the pair of predetermined side wall regions are made to be a pair of valve guide walls of a valve engaging portion which extends in the height direction, in which the predetermined connecting wall region is made to be a connecting wall of the valve engaging portion, which connects the pair of valve guide walls with each other at an intermediate portion of the pair of valve guide walls in the height direction, wherein a metal flow continues between the pair of valve guide walls, including distal ends, of the pair of valve guide walls and the connecting wall.

15. A method of manufacturing according to claim 14, wherein a metal flow continues between the valve guide walls including distal ends thereof and the connecting wall.

16. A method of manufacturing according to claim 16, wherein said alternately repeating is performed so as to adjust pressing forces for a predetermined gradual deformation of said valve engaging portion.

17. A method of manufacturing according to claim 14, wherein said portion of outer sides of the pair of predetermined side wall regions comprises an upper portion.

18. A method of manufacturing according to claim 14, wherein said portion of outer sides of the pair of predetermined side wall regions comprises a vicinity of a variation point of metal flow from the predetermined connecting wall regions to the predetermined side wall regions.

* * * * *